US011053047B2

(12) United States Patent
Curcic et al.

(10) Patent No.: US 11,053,047 B2
(45) Date of Patent: Jul. 6, 2021

(54) CONTAINER SYSTEM WITH IMPROVED MESSAGING STRUCTURE

(71) Applicant: The Procter & Gamble Company, Cincinnati, OH (US)

(72) Inventors: Nikola Curcic, Mechelen (BE); Eric Douglas Banks, Norwood, OH (US); Ashley Chonta Robinson, West Chester, OH (US); Mary Ellen Finnegan, Cincinnati, OH (US); Sofie Van Assche, Oost-Vlaanderen (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/933,702

(22) Filed: Mar. 23, 2018

(65) Prior Publication Data

US 2019/0291917 A1 Sep. 26, 2019

(51) Int. Cl.

| | |
|---|---|
| ***B65D 5/42*** | (2006.01) |
| ***B65C 3/08*** | (2006.01) |
| ***B65C 3/18*** | (2006.01) |
| ***B65D 73/00*** | (2006.01) |
| ***G09F 3/04*** | (2006.01) |
| ***B65D 47/08*** | (2006.01) |
| ***B65D 25/20*** | (2006.01) |

(52) U.S. Cl.

CPC ..... *B65D 5/4237* (2013.01); *B65C 3/08* (2013.01); *B65C 3/18* (2013.01); *B65D 25/205* (2013.01); *B65D 47/08* (2013.01); *B65D 73/0064* (2013.01); *G09F 3/04* (2013.01); *B65D 2203/00* (2013.01); *B65D 2501/24891* (2013.01); *B65D 2517/0053* (2013.01)

(58) Field of Classification Search

USPC ..... 206/459.5; 220/229, 731, 243, 244, 251, 220/249, 375, 652, 694

See application file for complete search history.

(56) References Cited

U.S. PATENT DOCUMENTS

| | | | | |
|---|---|---|---|---|
| 187,061 | A * | 2/1877 | Snow | G09F 1/10 40/658 |
| 370,540 | A * | 9/1887 | Hodge | B65D 5/4233 40/312 |
| 512,609 | A * | 1/1894 | Frazee | B65D 5/4233 40/312 |
| 534,799 | A * | 2/1895 | Koehler | G09F 3/16 40/666 |
| 1,983,139 | A | 12/1934 | Lovell | |

(Continued)

FOREIGN PATENT DOCUMENTS

| | | | |
|---|---|---|---|
| WO | WO2005118421 | A1 | 12/2005 |
| WO | WO2009126081 | A1 | 10/2009 |

OTHER PUBLICATIONS https://www.amazon.com/Munchkin-Piece-Snack-Catcher-Green/dp/B01GKZNWTO/ref=sr_1_3_a_it?ie=UTF8&qid=1518207464&sr=8-3&keywords=kids+snack+cups+no+spill&dpID=41OaLVNURfL&preST=_SY300_QL70_&dp (accessed Feb. 9, 2018).

(Continued)

*Primary Examiner* — Jacob K Ackun

(74) *Attorney, Agent, or Firm* — Gregory S. Darley-Emerson

(57) ABSTRACT

Container systems having improved messaging structures. Container systems that include a tab that partially occludes a mouth or passageway to an interior volume. Methods of making and using container systems.

20 Claims, 5 Drawing Sheets

(56) References Cited

U.S. PATENT DOCUMENTS 2,339,933 A * 1/1944 Lilienfield ..... A24F 15/02 217/61
2,659,486 A * 11/1953 Krupin ..... G07D 9/02 206/565
3,315,402 A * 4/1967 Scott ..... A01K 97/04 43/55
4,328,904 A 5/1982 Iverson
4,502,606 A * 3/1985 Shillington ..... A61M 5/3205 215/274
4,600,112 A * 7/1986 Shillington ..... A61M 5/3205 206/366
4,679,700 A * 7/1987 Tharrington ..... B65F 1/1607 220/229
4,844,717 A 7/1989 Croudace et al.
4,884,717 A * 12/1989 Bussard ..... A47G 19/30 220/229
5,024,327 A * 6/1991 Shillington ..... A61M 5/3205 206/366
D446,452 S 8/2001 Buck et al.
D449,528 S 10/2001 Buck et al.
6,499,626 B1 12/2002 Julius
6,655,544 B1 12/2003 Tanaka et al.
6,959,834 B2 11/2005 McDonald
7,597,213 B2 10/2009 McDonald
7,766,168 B2 * 8/2010 Thrapp ..... A45F 5/021 206/315.11
8,276,756 B2 10/2012 Denome et al.
8,302,798 B2 11/2012 Moss
8,985,363 B2 * 3/2015 Gubitosi ..... B65D 25/2867 206/366
2005/0109780 A1 * 5/2005 Pendergrass ..... B65D 43/0212 220/254.1
2007/0278227 A1 12/2007 Damaghi et al.
2010/0089935 A1 4/2010 Heilman
2010/0122985 A1 5/2010 Peters et al.
2012/0070106 A1 3/2012 Camargo-parodi
2013/0068765 A1 3/2013 Procter
2014/0001072 A1 * 1/2014 Christoffel ..... B65D 75/5833 206/459.5
2014/0238889 A1 8/2014 Sunder et al.
2014/0239054 A1 8/2014 Jackson
2016/0229599 A1 8/2016 Rogers et al.
2016/0251158 A1 * 9/2016 Ditzler ..... B65F 1/004 206/459.5
2017/0297770 A1 10/2017 Snider et al.
2017/0298558 A1 10/2017 English, III et al.
2017/0349341 A1 12/2017 Girardot et al.
2017/0349342 A1 12/2017 Girardot et al.

OTHER PUBLICATIONS

EP Search Report for appl. No. 19162176.2-1016, dated Aug. 9, 2019, 8 pages.

* cited by examiner

CONTAINER SYSTEM WITH IMPROVED MESSAGING STRUCTURE

FIELD OF THE INVENTION

The present disclosure relates to container systems having improved messaging structures. For example, the present disclosure relates to container systems that include a tab that partially occludes a mouth or passageway to an interior volume. The present disclosure also relates to related methods of making and using container systems.

BACKGROUND OF THE INVENTION

Consumer product manufacturers often desire to communicate certain information to the consumers that use their products. Such information may include safety information, instructional information, and/or branding/marketing information.

Traditionally, such information is located on the exterior of a package, for example on a label. Front panels of packages are typically designed to be attractive as seen at the time of purchase; other information, such as instructional, safety, or contact information, is often placed on a side or back panel. Because the front panel is relatively aesthetically pleasing compared to the other panels, the consumer may prefer that the front panel remains visible during normal storage and/or usage. However, this can mean that the manufacturer's communications remain hidden, forgotten, and/or easily ignored. Furthermore, a portion of the label, wherever it is located, may become scuffed or dirty upon transport or repeated use of the package, further obscuring the information.

Manufacturers and marketers have tried putting messaging on (or in) other parts of the package, but disadvantages persist. For example, removeable seals may be placed over the mouths of containers, but these may be challenging to remove, particularly for those with weak hand strength. A seal with slits may cover the entirety of a container mouth, but it can be challenging to get all of the contents out and/or see how much of the contents is left. Loose leaflets may be placed in the interior of containers but their sharp edges may damage the contents of the container; they may also get buried under the contents and fail to be visible by the user. "Hang tags" may be draped from the necks of bottles, but such systems can be costly to assemble, and the tags may obscure the primary messaging on the container. Furthermore, many of these messaging structures may be easily discarded by the user, meaning that the desired messaging is not reinforced upon repeated usage of the product.

In view of the above, it is clear that current container systems have technical problems in need of a technical solution. In short, there is a need for container systems that have improved messaging structures.

SUMMARY OF THE INVENTION

The present disclosure relates to container systems that have improved messaging structures, which may be in the form of a tab.

For example, the present disclosure relates to a container system that includes a container and a selectively openable cover, the container including a bottom wall and one or more side walls extending away from the bottom wall, the bottom wall and the one or more side walls defining an interior volume of the container, the container further comprising a rim defining a mouth to a passageway that provides access to the interior volume, the container further including a tab that partially occludes the mouth or passageway, the tab including a free end that is biased to a resting position, the free end being deflectable into the interior volume.

The present disclosure also relates to a process of making a container system, the process including the steps of: providing a container, the container having a mouth that provides access to a passageway to an interior volume of the container; and attaching a tab to the container so that the tab partially occludes the mouth and/or the passageway.

BRIEF DESCRIPTION OF THE DRAWINGS

The figures herein are illustrative in nature and are not intended to be limiting.

DETAILED DESCRIPTION OF THE INVENTION

Figure 1:
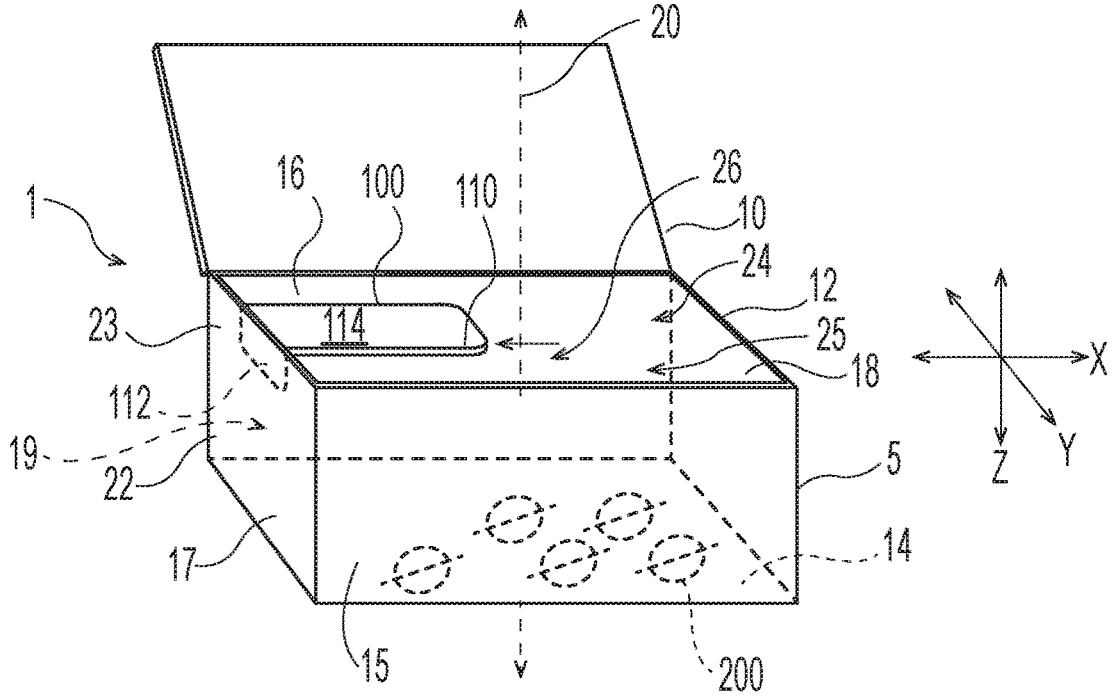
FIG. 1 shows a container system according to the present disclosure.

To address one or more of the technical problems stated above, the present application provides the solution of container systems having improved messaging structures. More specifically, the container systems of the present disclosure include a tab that partially occludes the mouth of the container and/or passageway extending from the mouth to the interior volume of the container. In broad strokes, the tab is located in the interior of the container system, but is positioned to be apart from—in effect, lifted away from or held above—the contents.

The tab may include a free end that, in a resting position, extends from near the edge of the mouth towards a central axis that passes through the mouth. The free end may be deflectable towards or into the interior volume of the container, for example by a hand reaching into the container to obtain a contained product. Once the defective force is removed (e.g., the hand), the free end may return to its resting position.

The tab may include communicational indicia, for example located on a top surface. The communicational indicia may relate to usage instructions (including dosing information), safety information, branding or marketing information, or combinations thereof. It is desired that the tab is sized and positioned so that the consumer physically interacts with the tab every time the interior volume is access, for example by the consumer's hand deflecting the tab while reaching for the contents of the container. Without wishing to be bound by theory, it is believed that by physically interacting with the tab when accessing the interior volume (particularly upon repeated usage), the consumer is more likely to notice and internalize the communicational indicia located thereon.

The container systems of the present disclosure are described in more detail below.

As used herein, the articles "a" and "an" when used in a claim, are understood to mean one or more of what is claimed or described. As used herein, the terms "include," "includes," and "including" are meant to be non-limiting. The compositions of the present disclosure can comprise, consist essentially of, or consist of, the components of the present disclosure.

The terms "substantially free of" or "substantially free from" may be used herein. This means that the indicated material is at the very minimum not deliberately added to the composition to form part of it, or, preferably, is not present at analytically detectable levels. It is meant to include compositions whereby the indicated material is present only as an impurity in one of the other materials deliberately included. The indicated material may be present, if at all, at a level of less than 1%, or less than 0.1%, or less than 0.01%, or even 0%, by weight of the composition.

As used herein the phrase "fabric care composition" includes compositions and formulations designed for treating fabric. Such compositions include but are not limited to, laundry cleaning compositions and detergents, fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation.

Unless otherwise noted, all component or composition levels are in reference to the active portion of that component or composition, and are exclusive of impurities, for example, residual solvents or by-products, which may be present in commercially available sources of such components or compositions.

All temperatures herein are in degrees Celsius (° C.) unless otherwise indicated. Unless otherwise specified, all measurements herein are conducted at 20° C. and under the atmospheric pressure.

In all embodiments of the present disclosure, all percentages are by weight of the total composition, unless specifically stated otherwise. All ratios are weight ratios, unless specifically stated otherwise.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Container Systems

The present disclosure relates to container systems. The container systems of the present disclosure may be suitable for containing consumer products, food products, pharmaceutical products, or any other product about which the manufacturer may wish to communicate information.

FIG. 1 shows an illustrative container system 1. The container system 1 may include a container 5 and a cover 10. The container system 1 also includes a tab 100 extending from near a rim 12 of the container 5 towards a central axis 20 of the container 5. The container 5 includes an interior volume 19, which may contain contents, such as unit dose articles 200. These elements are discussed in more detail below.

The cover 10 may be selectively openable. The cover 10 may have an open position, which allows access to the interior volume 19. The cover 10 may have a closed position, which may prevent access to the interior volume 19. The cover 10 may include an interior surface 21, which may face the interior volume 19 of the container when the cover 10 is in the closed position. As shown in FIG. 1, the cover 10 may be hingedly connected to the container 5 and may rotate around an axis when moving from the closed to open position, or vice versa. The container system 1 may be substantially water-tight when the cover 10 is in the closed position, which may be particularly advantageous when the container system 1 comprises water-sensitive contents, such as water-soluble unit dose articles 200. The container system 1 may include a child resistant feature that makes the cover 10 more challenging to open, such as a squeeze-and-turn feature, a press-and-turn feature, or latches/buttons that must be operated in a particular fashion.

The container 5 may include a bottom wall 14 and one or more side walls 15, 16, 17, 18 extending away from the bottom wall 14. The bottom wall 14 and the one or more side walls 15, 16, 17, 18 may cooperate to define the interior volume 19 of the container 5. The container 5 may include a front wall 15, a rear wall 16, a left side wall 17, and a right side wall 18, as viewed by an observer facing the front wall 15. The one or more side walls 15, 16, 17, 18 may each include a proximal end 22 located at or near the bottom wall 14 and a distal end 23 located away from the bottom wall 14.

The container 5 may include a rim 12. As shown in FIG. 1, the rim 12 may be defined by the one or more side walls 15, 16, 17, 18, for example by the proximal ends 22. The rim 12 may define a mouth 13 that provides access to a passageway 25 to the interior volume 19 of the container 5. The mouth 13 may have a shape that lies in a plane 26, such as the X-Y plane of FIG. 1.

The container 5 and cover 10 may be made of any suitable material. Typically, the container 5 is made of a relatively rigid material that generally keeps its shape. Any suitable polyolefin and/or polyesters may be use. The container 5 and/or cover 10 may be independently formed, partially or wholly, of a moldable thermoplastic material, such as polyethylene terephthalate, polypropylene, polyethylene, polystyrene, acrylonitryl butadiene styrene (ABS), polyester, polyvinyl chloride, polycarbonate or elastomer, or a combination (including blends) of these materials. The container 5 may comprise polyethylene terephthalate (PET), and the cover 10 may comprise polypropylene.

The container 5 may be of any suitable size. For example, the interior volume 19 may have a volume of at least about 0.5 L, or at least about 1 L, or at least about 2 L, or at least about 3 L, or at least about 4 L, or at least about 5 L, or at least about 6 L. The interior volume 19 may have a volume no more than about 100 L, or no more than about SOL, or no more than about 10 L, or no more than about 8 L, or no more than about 6 L, or no more than about 5 L, or no more than about 4 L, or no more than about 2 L, or no more than about 1 L.

As shown in FIG. 1, the container system may include a tab 100. The tab 100 may include two ends 110, 112 located away from each other. The tab may include a free end 110 and a fixed end 112. The fixed end 112 may be located near the rim 12 of the container 5. The free end 110 extends away from the rim 12, for example radially inwardly from the rim 12. The tab 100 may partially occlude the mouth 13 and/or passageway 25 to the interior volume 19. The tab 100 may be generally axially aligned with mouth 13, even if it the tab 100 is not touching the central axis 20. For example, if the shape defined by the rim 12 were to be moved axially along the central axis 20 (e.g., to substantially form a cylinder), it would intercept the tab 100.

The free end 110 may extend towards the central axis 20, which may be located substantially at the center of the mouth 13. As used herein, the phrase "extending towards" a reference point (or derivatives thereof) means extending in the direction of, to, or past the reference point. Thus, the free end 112 may be near or at the central axis 20.

The fixed end 112 of the tab 100 may be attached to the container 5. The fixed end 112 may be attached to a side wall 17, typically at or near the distal end 23. Although shown in FIG. 1 as an independent unit that is joined to the container 5, the present disclosure contemplates that the tab 100 may be an integral part of the container 5 (e.g., molded as part of the same piece).

Figure 2:
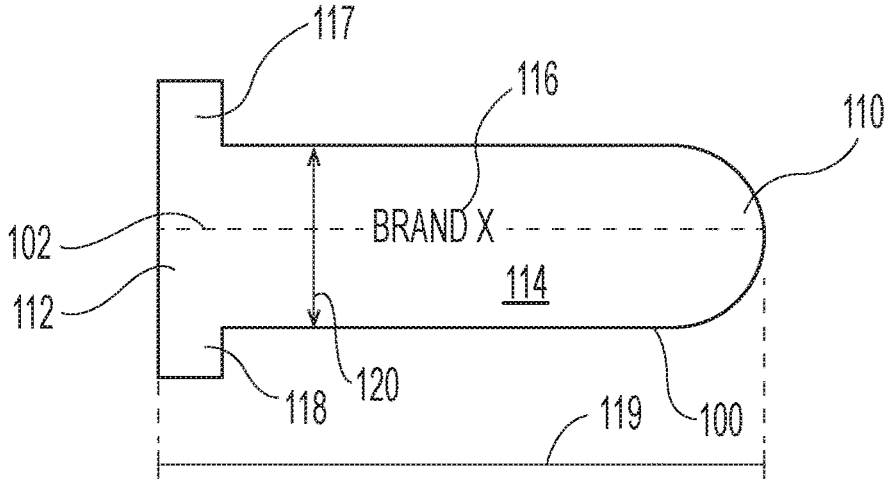
FIG. 2 shows a top view of a tab according to the present disclosure.
Figure 3:
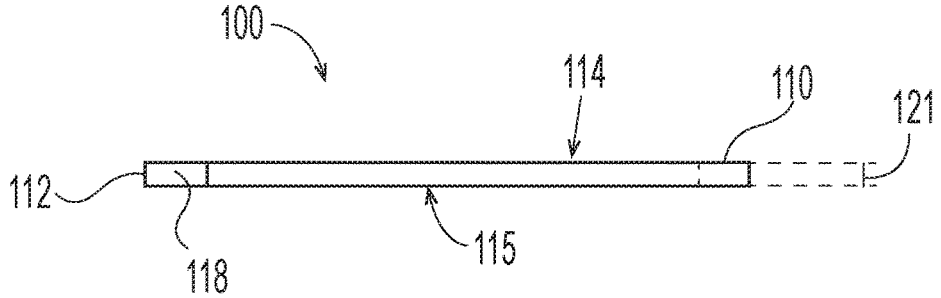
FIG. 3 shows a side view of a tab according to the present disclosure.

FIG. 2 shows a top view of a representative tab 100. FIG. 3 shows a side view of a representative tab 100. The tab 100 may be a piece separate from the container 5 and cover 10.

The tab 100 may have a top surface 114. When part of the container system 1, the top surface 114 may face the cover 10 when the cover 10 is in the closed position. When part of the container system 1, the top surface 114 may face away from the interior volume 19. When part of the container system 1, the top surface 114 may face away from the bottom wall 14. As described in more detail below, the top surface 114 may include communicational indicia 116.

The tab 100 may have a bottom surface 115 facing away from the top surface 114. When part of the container system 1, the bottom surface 115 of the tab 100 may face the interior volume 19.

The fixed end 112 of the tab 100 may include one or more feet 117, 118. The feet 117, 118 may be spaced away from a center line 102 of the tab 100. Each foot 117, 118 may provide additional surface area by which the fixed end 112 may be joined to the container 5, which is believed to provide a more secure attachment.

The tab 100 may have a tab length 119, measured as the distance from the end of the free end 110 to the end of the fixed end 112. The tab length 119 may be from about 50 mm to about 150 mm, or from about 60 mm to about 120 mm, or from about 70 mm to about 100 mm, or from about 75 mm to about 90 mm.

The tab 100 may have a free end width 120, measured as the widest portion of the free end 110 in a direction orthogonal to the tab length 119. The free end width 120 may be from 30 mm to about 120 mm, or from about 40 mm to about 100 mm, or from about 50 mm to about 80 mm, or from about 60 mm to about 70 mm.

The tab 100 may have a thickness 121, measured as the average caliper from the top surface 114 to the bottom surface 115. The thickness 121 may be from about 3 mils to about 12 mils, or from about 4 mils to about 12 mils, or from about 5 mils to about 10 mils, or from about 6 mils to about 8 mils, or about 7 mils (note: 1.0 mils=0.0254 mm). The thickness 121 may be from about 0.050 mm to 0.250 mm, or from about 0.080 mm to about 0.200 mm, or from about 0.100 mm to about 0.190 mm, or from about 0.150 mm to about 1.85 mm. The thickness 121 may be determined according to ASTM D6988. Without wishing to be bound by theory, a certain minimum thickness 121 may be desired because it is believed that tabs 100 that are too thin may cut the contained contents, such as unit dose articles 200, or the consumer's hand. Tabs 100 that are relatively thick may be undesirable because they may be difficult for the consumer to deflect in order to access the contents held in the interior volume 19. Additionally or alternatively, tabs 100 that are relatively thick may be more likely to crease upon deflection and fail to return to the resting position 128.

As shown in FIG. 2, the free end 110 of the tab 100 may be free of corners that have internal angles of about 90° or less. Sharp corners may be undesirable as they may puncture the contents, such as unit dose pouches 200, or scratch the consumer's hand. The free end 110 of the tab 100 may be substantially rounded.

The tab 100 may be made of any suitable material. Desirable materials are flexible enough to be deflected when accessing the interior volume and resilient enough to return to the tab's 100 original, resting position. Suitable materials include plastic materials, such as polyethyelene terephthalate (PET), polypropylene, or polystyrene. Cellulose-based materials, such as paper, may be used but may not as preferred, as they may not adequately return to the initial position and/or may cut the consumer's hand.

The tab 100 may be formed from a web of material. The web of material may be formed in a machine direction and may have particles or fibers generally aligned in the machine direction. The web of material may be characterized by a cross-direction that is orthogonal to the machine direction. The machine direction and cross direction may be determined by one of ordinary skill, for example, with the use of a microscope. Depending on the type of material, the material may be relatively stronger and/or resistant to flexure one of the machine direction or the cross-direction; one of ordinary skill with know or be able to determine in which direction the material is relatively stronger and/or resistant to flexure. The tab 100 may be cut from the web of material so that the tab length 119 of the tab 100 is substantially parallel to the cross-direction or machine direction of the web of material, preferably in whichever direction the material is stronger and/or resistant to flexure. Without wishing to be bound by theory, cutting the web in such a fashion provides improved stiffness to the tab 100 without having to add undue thickness, thereby saving on material costs and/or reducing the likelihood of creasing.

Figure 4:
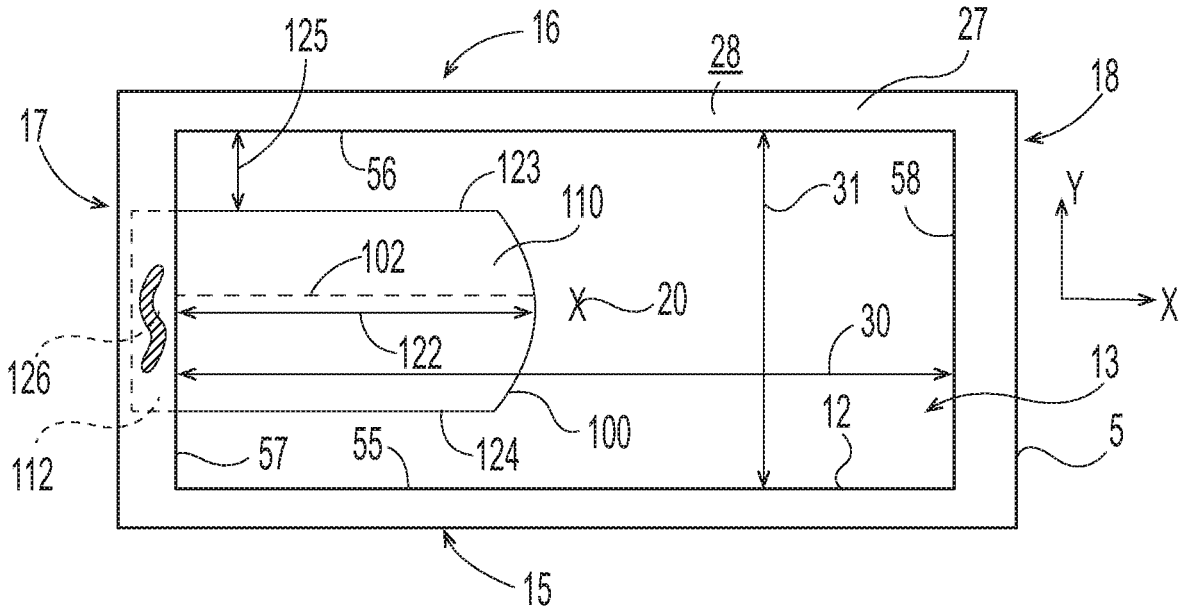
FIG. 4 shows a top view of a portion of a container system according to the present disclosure.
Figure 5:
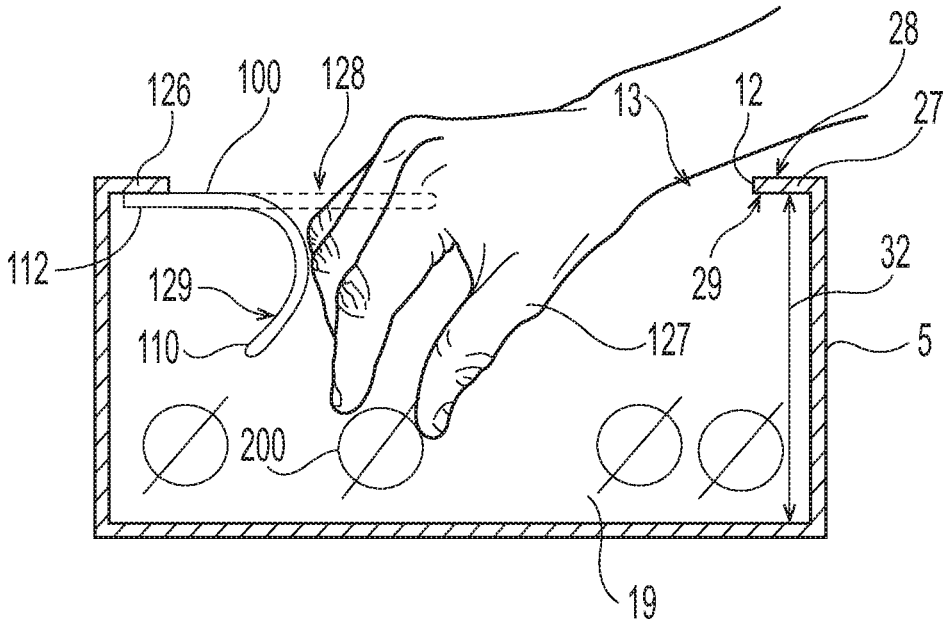
FIG. 5 shows a container system of the present disclosure in use.

FIG. 4 shows a top view of a container 5 and tab 100. The container 5 includes a shoulder 27. The shoulder 27 extends radially inwardly from the distal ends 23 of the one or more side walls 15, 16, 17, 18 towards the center axis 20 of the container 5. The inner edges of the shoulder 27 may define the rim 12. The rim 12 may include a front rim edge 55 that is near the front wall 15, a rear rim edge 56 that is near the rear wall 16, a left rim edge 57 that is near the left side wall 17, and a right rim edge 58 that is near the right side wall 18. When viewed from above the top surface 114 of the tab 100, the tab 100 may appear to extend from one rim edge 57 and be spaced apart from one or more of the remaining rim edges 55, 56, 58. For example, the tab 100 may appear to extend from the left rim edge 57 and be spaced apart from the front rim edge 55, the rear rim edge 56, and the right rim edge 58. This configuration may be preferred, given that many consumers may reach in with a right hand as shown in FIG. 5 (and optionally may grip the container system 1 with a left hand), thereby maximizing interaction with the tab 100. The tab 100 may appear to extend from the right rim edge 58 and be spaced apart from the front rim edge 55, the rear rim edge 56, and the left rim edge 57. The tab 100 may appear to extend from the front rim edge 55 but not the others 56, 57, 58. The tab 100 may appear to extend from the rear rim edge 56 but not the others 55, 57, 58.

The shoulder 27 may include a top surface 28 that faces away from the interior volume 19. The shoulder 27 may include an internal surface 29 (not shown in FIG. 4) that faces towards the interior volume. In the illustrative embodiment shown in FIG. 4, the fixed end 112 of the tab 100 is attached to the shoulder 27, specifically to the internal surface 29 of the shoulder 27. The tab 100 may be attached by an adhesive 126.

The mouth 13 may have a major dimension 30, the greatest length measured along a line that is in the plane of the mouth 13 and is substantially orthogonal to the one or more side walls 17, 18. In FIG. 4, the major dimension 30 is measured from the rim 12 near the left side wall 17 to the rim 12 near the right side wall 18. The major dimension 30 may be from 7 cm, or from about 8 cm, to about 30 cm, or to about 25 cm, or to about 20 cm, or to about 15 cm, or to about 12 cm, or to about 10 cm.

The mouth 13 may have a minor dimension 31, the greatest length measured along a line that is in the plane of the mouth 13 and is substantially orthogonal to the major dimension 30. In FIG. 4, the minor dimension 31 is measured from the rim 12 near the front wall 15 to the rim 12 near the rear wall 16. The minor dimension 31 may be from 7 cm, or from about 8 cm, to about 30 cm, or to about 25 cm, or to about 20 cm, or to about 15 cm, or to about 12 cm, or to about 10 cm.

The major dimension 30 and the minor dimension 31 may be of the same measurement, for example, when the mouth 13 is in the shape of a circle. For example, the mouth 13 may be in the shape of a circle having a diameter of about 9 cm.

The rim 12 may define the mouth 13, which may be in a shape having a surface area. The surface area of the shape of the mouth 13 may be from 50 $cm^2$, or from about 60 $cm^2$, to about 300 $cm^2$, or to about 250 $cm^2$, or to about 200 $cm^2$, or to about 150 $cm^2$, or to about 100 $cm^2$. Somewhat larger mouths 13 may be preferred so that a consumer's hand can fit through it. On the other hand, the size of the mouth 13 may be limited so that an efficient cover 10 can be provided, which may be particularly pertinent if the cover 10 is of the squeeze-and-turn type, as a consumer's hand may need to span across the cover 10.

The fixed end 112 of the tab 100 may be near to the one or more side walls 15, 16, 17, 18. The fixed end 112 may be near the left side wall 17 or right side wall 18, locations which are believed to increase the interaction of the tab 100 with the consumer.

As shown in FIG. 4, the tab 100 does not occlude the entirety of the mouth 13, nor does it stretch around the entirety of the rim 12. It is believed that occluding less than 100% of the mouth provides certain benefits. For example, with space between the tab 100 and the rim 12, the consumer can still easily see into the interior volume 19 of the container 5 and assess how much or little of the contents remain. A tab 100 having a smaller footprint saves on costs of materials. A tab 100 having a single attachment point near a portion of the rim 12 that is adjacent to a single wall 17 (instead of around the entirety of the rim 12) can save on adhesive costs and be less likely to rip or tear compared to a film over the entire mouth 13. Furthermore, it is believed that a tab 100 having relatively smaller footprint is less likely to cause frustration in the consumer upon repeated interactions. In effect, it can be advantageous to make the tab 100 large enough to be consistently interacted with, but not so large that it annoys the consumer, which may drive him or her to remove the tab 100 altogether or refuse to buy the product in the future.

As shown in FIG. 4 and as described above, the fixed end 112 is attached to the shoulder 27 and is substantially blocked from view, while the free end 110 extends radially inwardly towards the central axis 20 of the container 5. Because only a portion of the tab 100 is visible when viewed from above, the tab 100 may be characterized by a visible free end length 122. The visible free end length 122 is measured from the rim 12 to the distal end of the free end 110. For efficiency, it is desirable that a majority of the tab 100 is visible from above. The visible free end length 122 may be at least 50%, or at least 60%, or at least 70%, or at least 80% of the length 119 of the tab 100. The visible free end length 122 may be less than 99%, or less than 95%, of the length 119 of the tab 100.

The surface area of the visible portion of the free end 110 when viewed from above may also be determined according to methods known to one of ordinary skill.

The length 119 of the tab 100 may be substantially parallel to the major dimension 30. Without wishing to be bound by theory, it is believed that this orientation increases the consumer's interaction with the tab 100. The size of the tab 100 (or at least of the visible free end length 122) should be selected with the size of the mouth 13 and its major dimension 30 in mind. When the ratio of the visible free end length 122 to the major dimension 30 is too great, the tab 100 may become difficult to operate and/or may not return to its resting position. When the ratio is too low, consumers may not interact with the tab 100 enough because it is relatively too small. The visible free end length 122 may be up to about 75%, or up to about 50%, or up to about 40% of the major dimension 30 of the mouth 13. The visible free end length 122 may be at least 10%, or at least 20%, or at least 30%, or at least 40% of the major dimension 30.

Although less preferred, the length 119 of the tab 100 may be substantially parallel to the minor dimension 31. The visible free end length 122 may be up to about 75%, or up to about 50%, or up to about 40% of the minor dimension 31 of the mouth 13. The visible free end length 122 may be at least 10%, or at least 20%, or at least 30%, or at least 40% of the minor dimension 31.

The surface area of the visible portion of the free end 110 may be at least about 10%, or at least about 20%, or at least about 30%, or at least about 40% of the surface area of the shape of the mouth 13. The surface area of the visible portion of the free end 110 may be up to about 70%, or up to about 60%, or up to about 50%, of the surface area of the shape of the mouth 13. Without wishing to be bound by theory, it is believed that it is desirable to cover enough of the mouth so that the user interacts with the tab 100 in a meaningful, consistent fashion, but not so much so as to be an annoyance or result in the interior volume 19 being difficult to access, physically or visually.

When viewed from above, the tab 100 may be adjacent to a portion of the rim 12. The length of rim 12 that is adjacent to the tab 100 may be near to only one side wall 17. The length of rim 12 that is adjacent to the tab 100 may be more than 2%, and less than 30%, or less than 25%, or less than 20%, or less than 15%, of the inner periphery of the rim 12 (e.g., the perimeter of the mouth 13). Put another way, the tab may extend inwardly from only one side of the container.

The free end 110 of the tab 100 may include side edges 123, 124, which are disposed away from a center line 102 of the tab 100 (e.g., the tab length 119). A shortest line from one side edge 123 to the other side edge 124 may be substantially parallel to the minor dimension 31 of the mouth 13.

The side edges 123, 124 may be spaced apart from the rim 12 by a distance 125. The distance 125 between a side edge 123 and the nearest portion of the rim 12 may be from about 1%, or from about 5% to about 25% of the minor dimension 31.

In addition to being structures that improve communication, the tabs 100 of the present disclosure may be also helpful in minimizing spills when the container system is tipped over or dropped. More specifically, because the tab 100 partially occludes the mouth 13 and/or passageway 25, the tab 100 may help to keep the contents inside the package in case of accidental spilling. To maximize such advantages, it may be desirable to relate the distance 125 between a side edge 123 and the nearest portion of the rim 12 to the smallest dimension of the contents of the container. If the distance 125 is, e.g., within the same order of magnitude, about the same, or even relatively smaller than the smallest dimension (on average) of the contents, then it is believed that the less of the contents will spill out during accidental tipping or droppage. The distance 125 between a side edge 123 and the nearest portion of the rim 12, e.g., the nearest rim edge which may be the front rim edge 55 and/or the rear rim edge 56 may be no greater than about 150%, or no greater than about 125%, or no greater than about 110%, or no greater than about 100%, or no greater than about 90%, or no greater than about 75% of the smallest dimension (on average) of the contents of the container 5. For example, if the smallest dimension of a unit dose article 200 contained in the container 5 is about 3 cm, the distance 125 may be no greater than about 4.5 cm, and it may be preferred that the distance 125 is 3 cm or less.

FIG. 5 shows a cut-away side view of the container 5 and tab 100 in use. The fixed end 112 of the tab 100 is attached to an internal surface 29 of a shoulder 27 of the container 5. As shown in FIG. 5, the tab 100 is attached by an adhesive 126. The container 5 holds a plurality of unit dose articles 200.

Initially, the free end 110 of the tab 100 is in a resting position 128, shown as a dashed shape in FIG. 5. In the resting position 128, the tab 100 is substantially parallel to the plane 26 of the mouth 13 and/or to the bottom wall 14. In the resting position 128, the tab 100 is suspended away from (e.g., above) the unit dose articles 200. Leaving space between the tab 100 and the contents of the container 5 can minimize contact during transport and storage, thereby minimizing potential damage to the contents.

To access an article 200, a user extends a hand 127 through the mouth 13 and into the interior volume 19 of the container 5. In doing so, the hand 127 makes contact with the free end 110 of the tab 100 and exerts a deflecting force. The force of the contact deflects the free end 110 downwardly into the interior volume of the container 5 and into a deflected position 129. The hand 127 grabs one or more unit dose articles 200 and withdraws from the interior volume 19. When the hand 127 is no longer in contact with the free end 110 and therefore is no longer applying a deflective force, the free end 110 returns to its resting position 128.

The length 119 of the tab 100 may be selected so that it does not touch the bottom wall 14 when in a deflected position. For example, the free end 110 of the tab may have a length that is less than the average height 32 of the interior volume 19.

The tab 100 may be joined to the container 5 in any suitable fashion, such as by pressure sealing, heat sealing, an adhesive, welding, mechanical joint or combinations thereof. As shown in FIG. 5, the tab 100 is joined at the fixed end 112 to the shoulder 27 of the container 5 by an adhesive 126. The adhesive 126 may be selected to so that the tab 100 cannot be easily removed by a consumer, making it effectively permanently attached. Alternatively, the adhesive 126 may be selected so that the tab 100 can be removed easily by the consumer, effectively giving the consumer the choice as to keep the tab 100 in place or not. Suitable adhesives include permanent adhesives, polymer-based adhesives, pressure sensitive adhesives, or combinations thereof, preferably pressure sensitive adhesives.

The tab 100 may be integrally formed with the container 5 or a part thereof (e.g., a shroud 7, as described below). Forming the container 5 (or shroud 7) in combination with the tab 100 as a single piece can reduce manufacturing complexity, as no joining step is required. On the other hand, such a configuration may be challenging to mold and may thus be less preferred.

The container 5 may include handle structures, which can make the container system 1 easier to grip when carrying, opening, and/or removing some of the contents.

Figure 6:
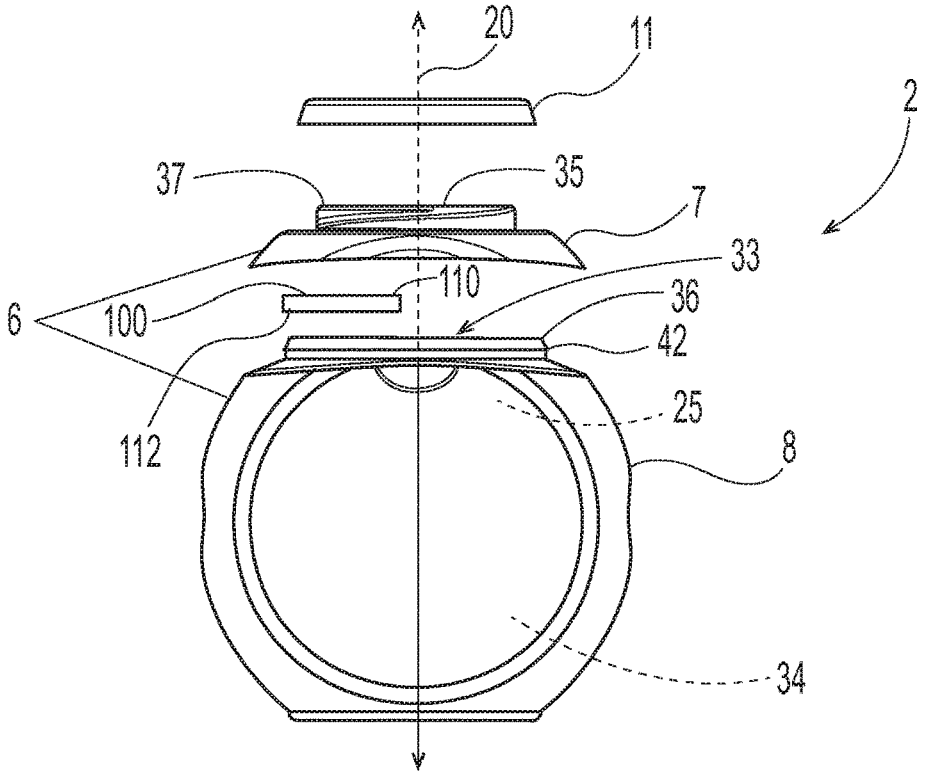
FIG. 6 shows another container system according to the present disclosure.

FIG. 6 shows an exploded view of another container system 2 according to the present disclosure. The container system 2 includes a cover 11 and a container 6 in two parts, a shroud 7 and a container body 8. The shroud 7 is connectable to the container body 8. The cover 11 is selectively removeable and can snap or twist onto the shroud 7.

The container body 8 includes a body mouth 33, which may be defined by a body rim 36, and an interior volume 34. The shroud 7 fits over the body mouth 33 and includes a shroud mouth 35 that is substantially in alignment with the body mouth 33, forming a passageway 25 and allowing fluid communication to the interior volume 34. When the shroud 7 is connected to the container body 8 to form the container 6, the shroud mouth 35 acts as the mouth 13 of the container 6.

The tab 100 is sized and configured to fit between the shroud 7 and the container body 8. The tab 100 may be located so that the fixed end 112 of the tab 100 is in contact with the shroud 7 and the container body 8 when the container system 2 is assembled. The fixed end 112 may be in contact with, or even pinched between, the bottom surface of the shroud 38 and the body rim 36 of the container body 8. Such a configuration can help to keep the tab 100 securely in place.

The free end 110 of the tab extends towards the central axis 20 of the container 6 and will partially occlude the passageway 25 to the interior volume 34 when the container system 2 is in assembled form. As described above, the free end 110 of the tab may be deflected by a deflective force towards the interior volume 34, for example when a hand 127 reaches in to access the contents of the container system 2.

Figure 7:
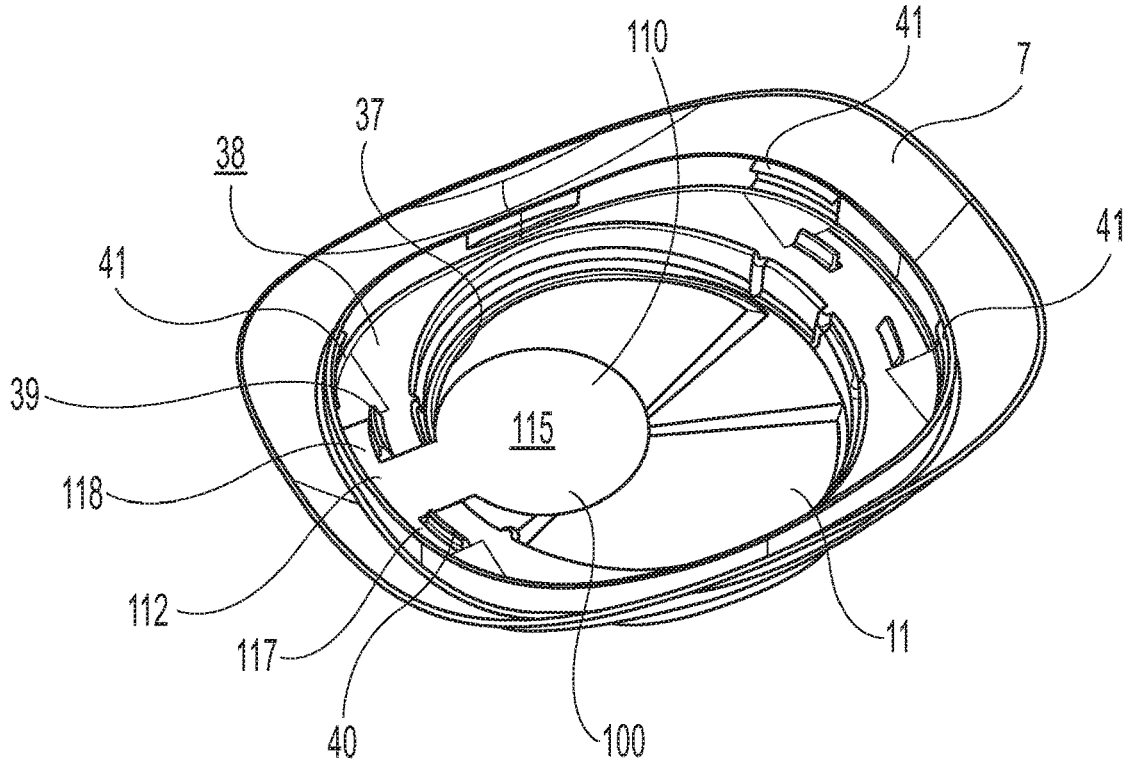
FIG. 7 shows a bottom perspective view of a shroud, tab, and cover according to the present disclosure.

FIG. 7 shows a bottom perspective view of an assembled shroud 7, cover 11, and tab 100. As shown, the cover 11 is provided in a closed position on the shroud 7.

As shown in FIG. 7, the free end 110 of the tab 100 extends past the rim 37 of the shroud 7 and partially occludes the shroud mouth 35. The fixed end 112 of the tab 100 is attached to a bottom surface 38 of the shroud 7, for example by an adhesive 126.

The shroud 7 may comprise one or more projections 39, 40. The shroud 7 may include one or more connecting features 41, such as snap beads or threading, that can connect to complementary features 42 on a container body 8.

The fixed end 112 of the tab 100 may include feet 117, 118 that extend away from a center line 102 of the tab 100. As shown in FIG. 7, the feet 117, 118 are sized and configured to sit next to the projections 39, 40 of the shroud 7. The projections 39, 40 extend away from the bottom surface 38 of the shroud 7 and/or towards the interior volume 34 when the shroud 7 is connected to the container body 8. The projections 39, 40 may be located next to the fixed end 112 of the tab 100. The projections 39, 40 can help to secure the fixed end 112 of the tab 100. For example, the projections 39, 40 may block the fixed end 112 from moving radially inwardly towards the central axis 20 upon repeated usage or upon pulling/attempted removal by a user. The fixed end 112 may be at least partially located between the projections 39, 40, which may help to center the tab 100 and/or facilitate alignment of the free end 110 with the mouth 13. As shown in FIG. 7, the projections 39, 40 may be located radially inwardly to at least a portion of the fixed end 112, preferably to feet 117, 118 of the fixed end 112 of the tab 100.

Although not shown, the feet 117, 118 may be radially inward compared to the projections. Such a design may be relatively easier to assemble, as the feet 117, 118 do not need to be tucked behind the projections 39, 40; instead, the fixed end 112 may be slid into place. The fixed end 112 may include a tail 150 (not shown in FIG. 7) that may be located between the projections 39, 40 and/or that extends radially away from where the feet 117, 118 extend away from the center line 102, which can help to properly align and/or secure the tab 100.

Although not shown, the fixed end 112 may include one or more slots that are configured to received one or more projections 117, 118, for example in a post-in-hole configuration, to facilitate secure anchoring of the tab 100.

Figure 8:
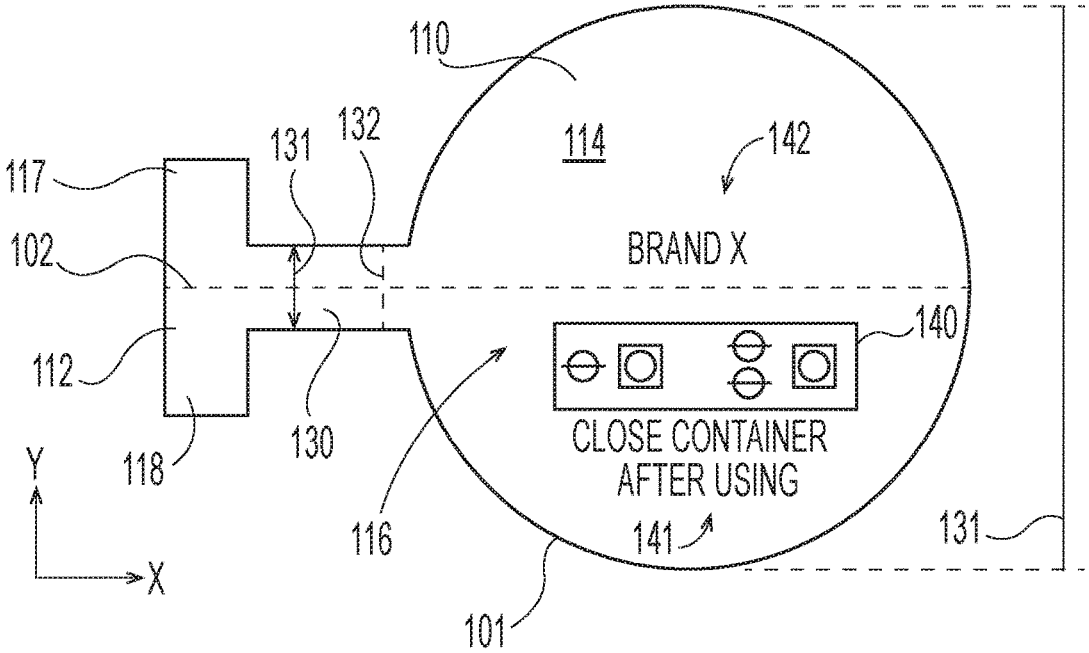
FIG. 8 shows a tab having indicia.

FIG. 8 shows another illustrative tab 101 according to the present disclosure. The fixed end 112 of the tab 101 includes feet 117, 118 extending away from a center line 102. The tab 101 includes a neck 130, which may connect, and be disposed between, the fixed end 112 and the free end 110. The neck 130 may have a width 131 that is relatively less than the free end width 120. Such a configuration may result in a more efficient use of material, as less material may be used in the neck to traverse areas that will not generally be visible to a user.

The neck 130 may include a line of weakness 132, such as a scored line and/or perforations, which may facilitate removal of the free end 110 by a user, if such an option is so desired. A line of weakness 132 may also make the free end 110 easier to deflect.

The tab 100 may include communicational indicia 116. The communicational indicia 116 may be disposed on a top surface 114 of the tab 100, preferably at the free end 110. Such a location increases visibility of the communicational indicia 116 upon normal usage of the container system, for example when the contents are accessed by a user.

The communicational indicia 116 may comprise instructional indicia 140, safety indicia 141, branding or marketing indicia 142, or combinations thereof. The communicational indicia 116 may take the form of text, graphics, symbols, or combinations thereof.

The communicational indicia 116 may include instructional indicia 140. Instructional indicia 140 may include instructions as to how to use the contents contained in the container system 1. Instructional indicia 140 may include dosing instructions, for example instructions correlating a laundry load size or soil level to a recommended dose of the composition. For example, the communicational indicia 116 of FIG. 8 shows a first laundry machine displaying a first load size being associated with a first dosage size comprising one unit dose article, and a second laundry machine displaying a second load size that is greater than the first load size being associated with a second dosing size comprising two unit dose articles.

The communicational indicia 116 may include safety indicia 141. The safety indicia 141 may relate to the composition contained therein. The safety indicia 141 may relate to the container system; for example, the safety indicia 141 may include a reminder to reclose the container system when finished with use.

The communicational indicia 116 may include branding or marketing indicia 142. The branding or marketing indicia 142 may include the brand name and/or brand logo of the contained product. The branding or marketing indicia 142 may relate to promotional offers, such as discounts or upcoming sales. The branding or marketing indicia 142 may relate to additional products from the manufacturer, including newly released products and/or products that are intended to be used in combination with the contained product. For example, if the contained product is a laundry detergent composition, the communicational indicia 116 may relate to pre-treatment products (e.g., a pretreat laundry additive products (e.g., scent booster and/or bleach additives), rinse-added products (e.g., fabric softeners), and/or products intended for use in a drying process (e.g., dryer sheets).

The communicational indicia 116 may include graphics. The graphics may include graphical representations of the contents of the container system. For example, when the container system comprises unit dose articles 200 in the interior volume 19 of the container 5, the tab 100 may include communicational indicia 116 that includes a graphical representation of one or more unit dose articles.

Figure 9:
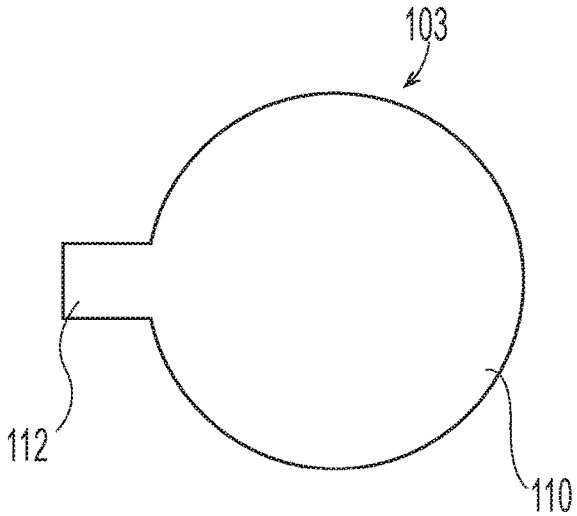
FIG. 9 shows a tab.
Figure 10:
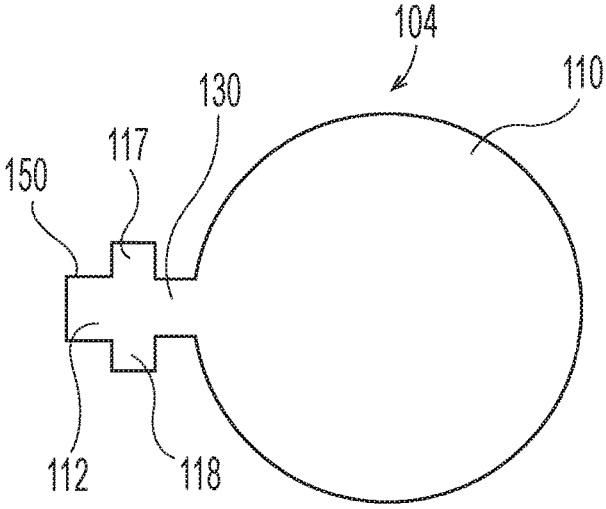
FIG. 10 shows a tab with feet.

FIGS. 9 and 10 show additional illustrative tabs 103, 104 according to the present disclosure. FIG. 9 shows a tab 103 having a circular free end 110 that is wider than the fixed end 112; the tab 103 has no feet. FIG. 10 shows a tab 104 having a fixed end 112 that includes a neck 130 connecting to the circular free end 110. The fixed end 112 also includes feet 117, 118 and a tail 150 that extends radially away from where the feet 117, 118 extend. The tail 150 can be sized and configured to sit between projections 39, 40 when the tab 104 is in an installed position, thereby helping with alignment and/or stability. The feet 117, 118 may be radially inward of projections 39, 40 when the tab 104 is in an installed position, thereby helping with alignment and/or stability. The feet 117, 118 may be shaped to conform to the edge of the shape of the mouth 13, which may be substantially circular.

Contents

The container system 1 may further comprise any suitable material or composition in the internal volume 19 of the container 5. For example, the container system 1 may comprise a household care composition. The container system 100 may comprise unitized dose articles 200, where water-soluble film encapsulates a composition in at least one compartment. The composition in the at least one compartment may comprise a liquid. Suitable materials and compositions are described in more detail below.

Typical materials and compositions include, but are not limited to, fabric care compositions, hard surface cleaners, soaps, shampoos, conditioning agents, pesticides, paint, solvents, industrial chemicals, industrial hardware (e.g., nails, screws, etc.), medicines, pills, food, and the like. The material may be water-sensitive material, meaning that the material has a tendency to dissolve or degrade when exposed to liquid water or water vapor. The material may be a consumer product, preferably a household care product, preferably a cleaning composition, more preferably a cleaning composition in the form of a unitized dose article.

Non-limiting examples of useful compositions include light duty and heavy duty liquid detergent compositions, hard surface cleaning compositions (such as dish care compositions, including compositions intended for use in an automatic dishwashing machine), detergent gels commonly used for laundry, bleach and laundry additives, shampoos, body washes, and other personal care compositions. Compositions may take the form of a liquid, gel, solid, a unitized dose article, or mixtures thereof. Liquid compositions may comprise a solid. Solids may include powder or agglomerates, such as micro-capsules, beads, noodles or one or more pearlized balls or mixtures thereof. Such a solid element may provide a technical benefit, through the wash or as a pre-treat, delayed or sequential release component; additionally or alternatively, it may provide an aesthetic effect.

The compositions may comprise one or more of the following non-limiting list of ingredients: opacifier; antioxidant; fabric care benefit agent; detersive enzyme; deposition aid; rheology modifier; builder; bleaching agent; bleach precursor; bleach catalyst; chelant; perfume; whitening agent; pearlescent agent; enzyme stabilizing systems; scavenging agents including fixing agents for anionic dyes, complexing agents for anionic surfactants, and mixtures thereof; optical brighteners or fluorescers; soil release polymers; dispersants; suds suppressors; dyes; colorants; hydrotropes such as toluenesulfonates, cumenesulfonates and naphthalenesulfonates; color speckles; colored beads, spheres or extrudates; clay softening agents; corrosion inhibitors and/or anti-tarnish agents; rinse aids. Additionally or alternatively, the compositions may comprise surfactants (including anionic, nonionic, and/or zwitterionic surfactants) and/or solvent systems.

The composition may be a flowable composition that can be scooped, such as a free-flowing granular or powdered composition. In such cases, the container system 1 may further comprise a scoop adapted to fit into the container system 1 and to scoop the scoopable composition. Such compositions may include granular detergents or ground coffee.

The container systems 1 described herein are particularly useful for containing compositions in the form of a unit dose article 200.

Typically, the container systems 1 described herein are useful for containing articles 200 of unitized doses of a composition (e.g., in counts of 15, 25, 50, 66, 77, etc.), typically of a cleaning composition, more typically of a laundry detergent or hard surface treatment composition. The unitized dose article 200 may be a pouch, which may include a single compartment.

Figure 11:
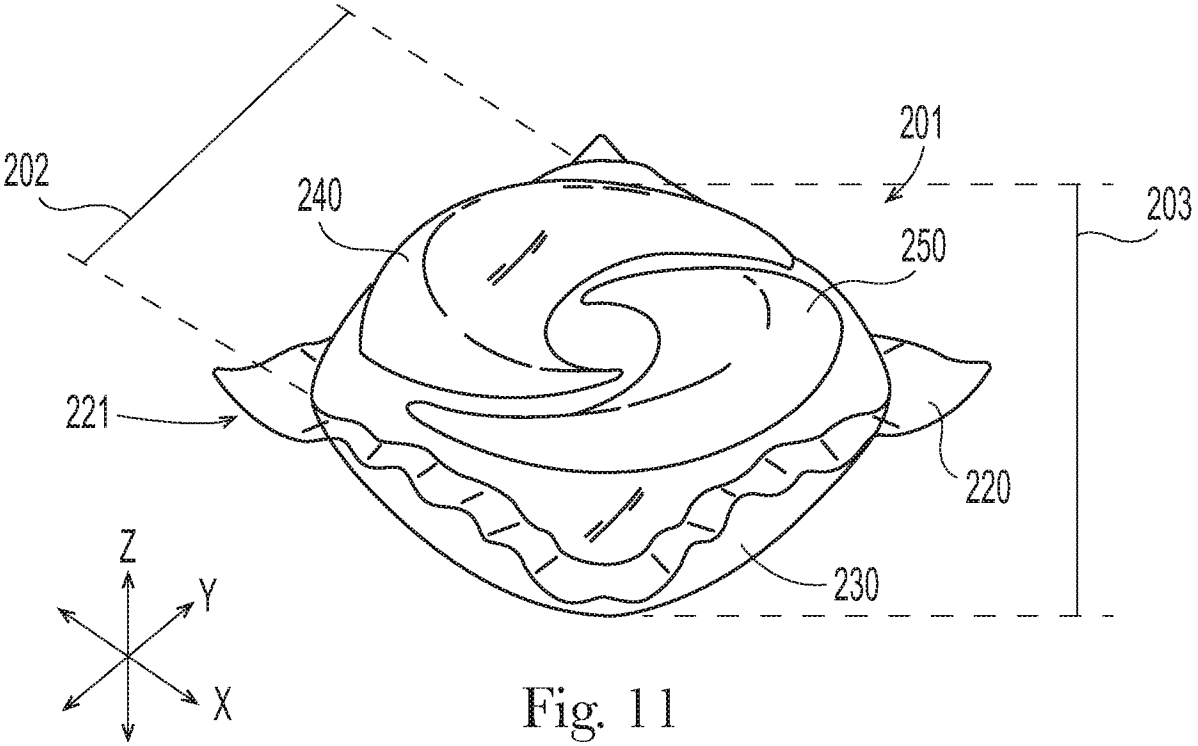
FIG. 11 shows a unit dose article according to the present disclosure.

As shown in FIG. 11, the unitized dose article 201 may comprise multiple compartments 230, 240, 250. The compartments may be side-by-side or superposed, for example one or two smaller compartments 240, 250 superposed on one larger compartment 230.

A multi-compartment article 201 may contain the same or different compositions in each separate compartment 230, 240, 250. The article 201 may contain various compositions, which may be of varying colors that may be seen from outside of the pouch. The multiple compartments 230, 240, 250 may be utilized to keep compositions containing incompatible ingredients (e.g., bleach and enzymes) physically separated or partitioned from each other. It is believed that such partitioning may extend the useful life and/or decrease physical instability of such ingredients.

The article 200, 201 may be formed from a water-soluble film 220, such as a polyvinyl alcohol film, including those available from MonoSol, LLC (e.g., M8630 film). The film 220 may form the compartments 230, 240, 250 that encapsulate the composition.

The compositions of the unitized dose articles 200, 201 typically have low levels of water, particularly when they comprise water-soluble film 220. In some aspects, the compositions contained in the compartments 230, 240, 250 may comprise less than about 50%, or less than about 30%, or less than about 20%, or less than about 15%, or less than about 12%, or less than about 10%, or less than about 8%, or less than 5%, or less than 2% water by weight of the composition. In some aspects, the compositions comprise from about 0.1% to about 20%, or from about 1% to about 12%, or from about 5% to about 10% water by weight of the composition.

The article 200, 201 may be suitable to be grasped by an adult human hand. Such articles 200, 201 may have an article width 202 of from about 10 mm to about 100 mm, or from about 20 mm to about 70 mm, or from about 35 mm to about 55 mm, or from about 40 mm to about 50 mm. If the article 200, 201 is rectangular in shape, the article width 202 is measured as the greatest distance between two parallel sides. When an article 200, 201 has a variable width, the article width 202 is the average of such widths. Such articles 200, 201 may have a height 203, of from about 10 mm to about 100 mm, or from about 15 mm to about 70 mm, or from about 20 mm to about 50 mm, or from about 25 mm to about 35 mm. When an article 200, 201 has a variable height, the article height 203 is measured at the maximum height of the article 200, 201. Measurement of such article width 202 and article height 203 does not include a skirt 221 that may be present around the exterior of the compartments 230, 240, 250, for example where two or more films 220 are joined.

Process of Making Container Systems

The present disclosure relates to processes of making container systems. The process may include the step of providing a container 5 and attaching a tab 100 to the container 100, the tab 100 partially occluding a mouth of the container and/or a passageway that provides access to an internal volume 19 of the container 5. The process may include the step of sealing the container 5.

The container 6 may include a shroud 7 and a container body 8. The process may include the step of attaching the tab 100 to the shroud 7. The process may include connecting the shroud 7 to the container body 8. The shroud 7 may be provided with the cover 11 already connected, preferably connected in a closed position.

The process may include applying an adhesive 126 to the tab 100, to the container 5, or both before joining them. When the container 6 includes a shroud 7 and a container body 8, the process may include applying adhesive 126 to the tab 100, to the shroud 7, and/or to the container body 8 before joining them, preferably to the tab 100 and/or to the shroud 7. The tab 100 may be attached to the shroud 7 before the shroud 7 is connected to the container body 8. Additionally or alternatively, the process of attaching the tab 100 may include applying heat and/or pressure, preferably at least pressure.

The process may include the step (e.g., a filling step) of providing contents, such as unit dose articles 200, to the interior volume 19 of the container 5. The process may include providing contents, such as unit dose articles 200, to the container body 8. The shroud 7, which may already have the tab 100 attached, may be connected to the container body 8 after such contents have been provided (e.g., after a filling step). It may be useful to perform such an order of operation because the body mouth 33 may be relatively larger than the shroud mouth 35, making the filling operation relatively easier. It may also be relatively easier to attach the tab 100 to the shroud 7 before the shroud 7 is connected to the container body 8 because when unattached, the shroud 7 is easier manipulate and/or it may be easier to access the bottom surface 38 of the shroud 7. Furthermore, the described order of operation allows the container body 8 to be filled without interference from the tab 100, which is intentionally placed to occlude the passageway 25 to the interior volume 34. Putting the tab 100 in place before the filling step could result in the tab 100 being trapped in the deflected position 129 and/or negatively impacting its ability to return to the resting position 128.

Process of Using Container Systems

The present disclosure relates to processes for using container systems. The processes may include the step of providing a container system 5, 6 according to the present disclosure. The container system 5, 6 may include contents, such as unit dose articles 200, in the interior volume 19, 34.

The process may include the step of moving the cover 10, 11 to an open position. The process may include accessing the interior volume 19, 34, for example with a hand 127, and deflecting the free end 110 of the tab 100 from the resting position 128 to a deflected position 129, for example by applying a deflecting force to a top surface 114 of the tab 100. The process may include removing contents, such as one or more unit dose articles 200, from the interior volume 19, 34. The process may include moving the cover 10, 11 to a closed position.

The process may include using the contents, such as the one or more unit dose articles 200, in an intended fashion. For example, a unit dose article 200 may be combined with and/or dissolved in water. The unit dose article 200 may rupture, disperse, and/or dissolve in the water, thereby releasing a composition in the water to form a treatment liquor.

The process may include contacting a surface to be treated, such as a fabric or hard surface, with the treatment liquor in a treatment process. The treatment process may take place in an automatic washing machine, such as an automatic laundry machine or an automatic dishwasher.

Combinations

Specifically, contemplated combinations of the disclosure are herein described in the following lettered paragraphs. These combinations are intended to be illustrative in nature and are not intended to be limiting.

A. A container system comprising a container and a selectively openable cover, the container comprising a bottom wall and one or more side walls extending away from the bottom wall, the bottom wall and the one or more side walls defining an interior volume of the container, the container further comprising a rim defining a mouth to a passageway that provides access to the interior volume, the container further comprising a tab that partially occludes the mouth or passageway, the tab comprising a free end that is biased to a resting position, the free end being deflectable into the interior volume.

B. A container system comprising a container and a selectively openable cover, the container comprising a bottom wall and one or more side walls extending away from the bottom wall, the bottom wall and the one or more side walls defining an interior volume of the container, the container further comprising a rim defining a mouth to a passageway that provides access to the interior volume, the rim encircling a central axis, the container further comprising a tab, the tab comprising a free end that is biased to a resting position that is substantially axially aligned with the mouth, optionally axially away from the mouth, the free end being deflectable into the interior volume.

C. A container system according to any of paragraphs A-B, wherein the tab is made of a material comprising plastic, preferably polyethyelene terephthalate (PET), polypropylene, or polystyrene, more preferably PET.

D. A container system according to any of paragraphs A-C, wherein the tab has a length that is substantially parallel to a major dimension of the mouth.

E. A container system according to any of paragraphs A-D, wherein the tab comprises a visible free end length that is up to about 75% of the major dimension of the mouth.

F. A container system according to any of paragraphs A-E, wherein the tab is adjacent to a portion of the rim that is near only one side wall.

G. A container system according to any of paragraphs A-F, where the portion of the rim that is adjacent to the tab has a length that is less than about 30% of an inner periphery of the rim.

H. A container system according to any of paragraphs A-G, wherein the mouth defines a shape having a surface area, wherein the tab has a top surface facing away from the interior volume of the container, wherein a visible portion of the free end of the tab when viewed from above the top surface also has a surface area, the surface area of the visible portion of the free end being less than about 50% of the surface area of the shape defined by the mouth.

I. A container system according to any of paragraphs A-H, wherein the interior volume has an average height, and wherein the free end of the tab has a length that is less than the average height of the interior volume.

J. A container system according to any of paragraphs A-I, wherein the tab comprises a top surface facing away from the interior volume of the container, the top surface comprising communicational indicia, preferably communicational indicia comprising instructional indicia, safety indicia, branding or marketing indicia, or combinations thereof.

K. A container system according to any of paragraphs A-J, wherein the communicational indicia comprises instructional indicia, preferably instructional indicia related to dosing contents of the container system.

L. A container system according to any of paragraphs A-K, wherein the container comprises a container body and a shroud that is connectable to the container body.

M. A container system according to any of paragraphs A-L, wherein the tab is attached to the shroud.

N. A container system according to any of paragraphs A-M, wherein the container or shroud includes projections extending away from a bottom surface, preferably of the shroud, the projections being next to a fixed end of the tab.

O. A container system according to any of paragraphs A-N, wherein the tab is pinched between the shroud and the container body.

P. A container system according to any of paragraphs A-O, wherein the interior volume comprises a plurality of unit dose articles, preferably wherein each article comprises a composition, preferably a household care composition, encapsulated in a water-soluble film.

Q. A container system according to any of paragraphs A-P, wherein the interior volume comprises a plurality of unit dose articles, wherein the articles are characterized by an average smallest dimension, wherein the tab comprises a side edge that is spaced apart from a rim edge, wherein the distance between a side edge of the tab and the rim edge is no greater than about 150%, preferably no great than about 125%, preferably no greater than about 100%, of the average smallest dimension.

R. A process of making a container system, such as a container system according to any of paragraphs A-Q, the process comprising the steps of: providing a container, the container having a mouth that provides access to a passageway to an interior volume of the container; and attaching a tab to the container so that the tab partially occludes the mouth and/or the passageway.

S. The process according to paragraph R, wherein the container comprises a container body and a shroud connectable to the container body, the container body comprising the interior volume.

T. The process according to paragraph S, wherein the tab is attached to the shroud.

U. The process according to any of paragraphs R-T, wherein the process further comprises a filling step, wherein contents are provided to the interior volume.

V. The process according to any of paragraphs R-U, wherein the process further comprises connecting the shroud to the container body after the filling step.

EXAMPLES

The examples provided below are intended to be illustrative in nature and are not intended to be limiting.

Example 1. Bend Resistance Test

To test bend resistance, strips of identical size were cut from various materials of various thicknesses. Two strips, sized 2.5 inches×0.5 inches (6.35 cm×1.27 cm), were cut from sheets of the materials; one strip was cut so that the longest dimension paralleled the machine direction (MD), and another strip was cut so that the longest dimension paralleled the cross-direction (XD) of the sheet. Held at a fixed end, the strips were forced to bend about 90°, and the tip of the free end was applied to a mass balance. The mass reading (in grams) was recorded as a proxy for the amount of force required to bend the strips. Results are shown below in Table 1.

TABLE 1

| Trial | Material | Thickness (mils) | Flex Test (g) MD | Flex Test (g) XD |
|---|---|---|---|---|
| 1 | PET | 5 | 1.41 | 1.62 |
| 2 | PET | 6 | 2.60 | 2.17 |
| 3 | PET | 7 | 3.74 | 4.73 |
| 4 | PET | 10 | 11.47 | 9.57 |
| 5 | PET (recycled) | 12 | 10.18 | 9.84 |
| 6 | Polystyrene | 7 | 1.50 | 1.70 |
| 7 | Polystyrene | 7 | 1.73 | 1.75 |
| 8 | Synthetic paper (polyolefin) | 8 | 1.99 | 3.94 |
| 9 | Synthetic paper (polyolefin) | 10 | 4.43 | 7.38 |

Example 2. Structure Thickness

To determine the preferred thickness of the messaging structure, thirty-six consumers were exposed to various containers. Each container included a messaging structure having a different thickness (3 mils, 5 mils, 7 mils, 12 mils). Each messaging structure was made of PET and was of identical shape, including a substantially circular free end. After being presented with the containers in monadic fashion, the consumers were asked to rank the messaging structures from most liked (1) to least liked (4). The mean ranks for each thickness are shown below in Table 2.

TABLE 2

| Thickness | Mean Rank |
|---|---|
| 3 mils | 2.4 |
| 5 mils | 1.14 |
| 7 mils | 1.08 |
| 12 mils | 1.40 |

As shown in Table 2, the structure having thickness of 7 mils achieved the top mean rank. The structure having a thickness of 5 mils was next.

Based on the tests run in Examples 1 and 2, it was determined that a structure made of PET and having a thickness of greater than 3 mils and less than 12 mils, or from about 4 to about 9 mils, or from about 5 to about 7 mils, is preferred.

Example 3. Preferred Cue

To test which type of messaging structure or cue provided the best response from consumers, a group of sixty-six consumer panelists were provided with a variety of containers. The containers each included dosing instructions provided on a different messaging cue. For each cue, the dosing instructions/imagery was kept constant and indicated that two unitized dose laundry articles or "pacs" (e.g., TIDE PODS™) were suitable for a "large" load of laundry (9 lbs [4.1 kg] for top-load machines, 11 lbs [5.0 kg] for front-load machines). A key to each Messaging Cue is provided below in Table 3.

Panelists were matched with a laundry machine that was the same type as they used at home (top-load or front-load), and were presented with a corresponding "large" load of laundry. Panelists were presented with containers having one of Messaging Cues A-E in random order, and were asked to start a load of laundry. Of the sixty-six panelists, thirty-nine expressly noticed at least one of the Messaging Cues, evidenced, for example, by verbal comment and/or closer examination of the cue and its informational content; twenty-seven did not expressly notice any of the Messaging Cues ("no interaction").

Dosing behavior for the "no interaction" group and for those that noticed at least one messaging cue (presented as Trials A-E) was recorded, and the results (as average number of pacs dosed to the provided large load of laundry, where two pacs are recommended) are presented below in Table 3.

TABLE 3

| Trial | Description of Messaging Cue | Avg. no. of pacs dosed (recommended: 2) |
|---|---|---|
| No interaction | — | 1.41 |
| A | Circular tab extending into circular passageway | 1.83 |

TABLE 3-continued

| Trial | Description of Messaging Cue | Avg. no. of pacs dosed (recommended: 2) |
|---|---|---|
| B | Leaflet placed loose in the container | 1.61 |
| C | Sticker on top of lid | 1.63 |
| D | Rectangular tab extending into circular passageway | 1.77 |
| E | Removeable seal over mouth of container | 1.75 |

As shown in Table 3, those panelists that noticed at least one of the Messaging Cues (Trials A-E) tended to dose a greater number of laundry pacs, and closer to the recommended dose, than those panelists that did not notice the cues ("no interaction").

In the group that noticed at least one of the Messaging Cues, Trial A resulted in the greatest number of pacs being dosed on average; the 1.83 pacs on average was closest to the recommended dose of 2. Trial D resulted in the second-most pacs being dosed on average. Without wishing to be bound by theory, it is believed that when the consumer interacts with the messaging structures of the present disclosure by deflecting the structure when reaching into the interior volume, the consumer is more likely to notice, internalize, and follow the dosing instructions, compared to alternative structures.

Based on qualitative data collected from consumer panelists in a follow-up test, a messaging structure having a circular free end was preferred to a messaging structure having a rectangular end; the circular structure was seen as less likely to cause discomfort during interactions and/or was more visually appealing, at least when aligned with a circular mouth of the container. With regard to attachment location, a structure extending from near the side of the container and a structure extending from near the front of the container were found to be similarly preferred.

Example 4. Exemplary Unit Dose Formulations

The container systems of the present disclosure may contain unit dose articles. The unit dose articles may include two or three compartments, each containing a composition. Exemplary formulations and amounts for compositions contained in the compartments are provided below in Table 4. The articles may be in the form of pouches, which may be formed from any suitable film, such as M8630 film from MonoSol, LLC (Indiana, USA).

TABLE 4

| | A 3 compartments | | | B 2 compartments | | C 3 compartments | | |
|---|---|---|---|---|---|---|---|---|
| Compartment # | 1 | 2 | 3 | 1 | 2 | 1 | 2 | 3 |
| Dosage (g) | 34.0 | 3.5 | 3.5 | 30.0 | 5.0 | 25.0 | 1.5 | 4.0 |
| Ingredients | Weight % | | | | | | | |
| Alkylbenzene sulfonic acid | 20.0 | 20.0 | 20.0 | 10.0 | 20.0 | 20.0 | | |
| Alkyl sulfate | | | | 2.0 | | | | |
| C12-14 alkyl 7-ethoxylate | 17.0 | 17.0 | 17.0 | | 17.0 | 17.0 | | |
| Cationic surfactant | | | | 1.0 | | | | |
| Zeolite A | | | | 10.0 | | | | |
| C12-18 Fatty acid | 13.0 | 13.0 | 13.0 | | 18.0 | 18.0 | | |
| Sodium acetate | | | | 4.0 | | | | |
| enzymes | 0-3 | 0-3 | 0-3 | 0-3 | | 0-3 | | |
| Sodium Percarbonate | | | | 11.0 | | | | |
| TAED | | | | 4.0 | | | | |
| Organic catalyst[1] | | | | 1.0 | | | | |
| PAP granule[2] | | | | | | | | 50 |
| Polycarboxylate | | | | 1.0 | | | | |
| Polyethyleneimine ethoxylate[3] | 2.2 | 2.2 | 2.2 | | | | | |
| Hydroxyethane diphosphonic acid | 0.6 | 0.6 | 0.6 | 0.5 | | | | |
| Ethylene diamine tetra(methylene phosphonic) acid | | | | | | 0.4 | | |
| Brightener | 0.2 | 0.2 | 0.2 | 0.3 | | 0.3 | | |
| Mineral oil | | | | | | | | |
| Hueing dye[4] | | | 0.05 | | 0.035 | | 0.12 | |
| Perfume | 1.7 | 1.7 | | 0.6 | | 1.5 | | |
| Water and minors (antioxidant, aesthetics, etc.) | 10.0 | 10.0 | 10.0 | 4.0 | | | | |
| Buffers (sodium carbonate, monoethanolamine)[5] | To pH 8.0 for liquids<br>To RA > 5.0 for powders | | | | | | | |
| Solvents (1,2 propanediol, ethanol) for liquids, sodium sulfate for powders | To 100% | | | | | | | |

[1]Sulfuric acid mono-[2-(3,4-dihydro-isoquinolin-2-yl)-1-(2-ethyl-hexyloxymethyl)-ethyl]ester as described in U57169744

[2]PAP = Phtaloyl-Amino-Peroxycaproic acid, as a 70% active wet cake

[3]Polyethylenimine (MW = 600) with 20 ethoxylate groups per NH.

[4]Ethoxylated thiophene, EO (Rt-FR2) = 5

[5]RA = Reserve Alkalinity (g NaOH/dose)

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container system comprising a container and a selectively openable cover, the container comprising a bottom wall and one or more side walls extending away from the bottom wall, the bottom wall and the one or more side walls defining an interior volume of the container, the container further comprising a rim defining a mouth to a passageway that provides access to the interior volume, the container further comprising only one tab, wherein the tab is a single unitary piece, wherein the tab comprises a fixed end that attached to the container, wherein the tab is joined to the container by pressure sealing, heat sealing, an adhesive, welding, or combinations thereof, wherein the tab is positioned to partially occlude the mouth or passageway such that there is a space between the tab and the rim so that a consumer can see into the interior volume of the container, the tab comprising a free end that is biased to a resting position, the free end being deflectable by a deflecting force into the interior volume, wherein the free end returns to the resting position once the deflective force is removed.

2. A container system according to claim 1, wherein the tab is made of a material comprising plastic.

3. A container system according to claim 1, wherein the tab has a length that is substantially parallel to a major dimension of the mouth.

4. A container system according to claim 1, wherein the tab comprises a visible free end length that is up to about 75% of the major dimension of the mouth.

5. A container system according to claim 1, wherein the tab is adjacent to a portion of the rim that is near only one side wall.

6. A container system according to claim 5, where the portion of the rim that is adjacent to the tab has a length that is less than about 30% of an inner periphery of the rim.

7. A container system according to claim 1, wherein the mouth defines a shape having a surface area, wherein the tab has a top surface facing away from the interior volume of the container, wherein a visible portion of the free end of the tab when viewed from above the top surface also has a surface area, the surface area of the visible portion of the free end being less than about 50% of the surface area of the shape defined by the mouth.

8. A container system according to claim 1, wherein the interior volume has an average height, and wherein the free end of the tab has a length that is less than the average height of the interior volume.

9. A container system according to claim 1, wherein the tab comprises a top surface facing away from the interior volume of the container, the top surface comprising communicational indicia.

10. A container system according to claim 9, wherein the communicational indicia comprises instructional indicia.

11. A container system according to claim 1, wherein the container comprises a container body and a shroud that is connectable to the container body.

12. A container system according to claim 11, wherein the tab is attached to the shroud.

13. A container system according to claim 12, wherein the shroud includes projections extending away from a bottom surface of the shroud, the projections being next to the fixed end of the tab.

14. A container system according to claim 12, wherein the tab is pinched between the shroud and the container body.

15. A container system according to claim 1, wherein the interior volume comprises a plurality of unit dose articles.

16. A container system according to claim 1, wherein the interior volume comprises a plurality of unit dose articles, wherein the articles are characterized by an average smallest dimension, wherein the tab comprises a side edge that is spaced apart from a rim edge, wherein the distance between a side edge of the tab and the rim edge is no greater than about 150% of the average smallest dimension.

17. A container system according to claim 1, wherein the mouth is of a shape that lies in a plane, and wherein when the tab is in the resting position, the tab is substantially parallel to the plane of the mouth.

18. A container system according to claim 1, wherein when the tab is in the resting position, the tab is substantially parallel to the bottom wall.

19. A container system according to claim 1, wherein the fixed end of the tab comprises feet that extend away from a center line of the tab.

20. A container system according to claim 1, wherein the tab has a thickness of from about 3 mils to about 12 mils, wherein the thickness is measured as the average caliper from a top surface of the tab to a bottom surface of the tab.

* * * * *